US010096918B1

(12) United States Patent
Nakamura

(10) Patent No.: US 10,096,918 B1
(45) Date of Patent: Oct. 9, 2018

(54) CONNECTOR

(71) Applicant: Japan Aviation Electronics Industry, Limited, Tokyo (JP)

(72) Inventor: Keisuke Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/871,405

(22) Filed: Jan. 15, 2018

(30) Foreign Application Priority Data

Mar. 17, 2017 (JP) ..... 2017-053389

(51) Int. Cl.
*H01R 12/00* (2006.01)
*H01R 12/61* (2011.01)
*H01R 12/67* (2011.01)

(52) U.S. Cl.
CPC ..... *H01R 12/616* (2013.01); *H01R 12/67* (2013.01)

(58) Field of Classification Search
CPC ..... H01R 12/79; H01R 12/616; H01R 12/62; H01R 12/592; H01R 12/78; H01R 12/61; H01R 12/777; H01R 12/77; H01R 12/59; H01R 12/675; H01R 12/67
See application file for complete search history.

(56) References Cited

U.S. PATENT DOCUMENTS 9,252,515 B2 * 2/2016 Komoto ..... H01R 12/716
9,478,879 B2 * 10/2016 Iwano ..... H05K 1/114
9,685,725 B2 * 6/2017 Komoto ..... H01R 13/41

FOREIGN PATENT DOCUMENTS

JP 2005-63872 A 3/2005

* cited by examiner

*Primary Examiner* — Xuong Chung Trans
(74) *Attorney, Agent, or Firm* — Muncy, Geissler, Olds & Lowe, P.C.

(57) ABSTRACT

A connector includes a base member having a first surface facing a bottom surface of a flexible substrate, a contact having a second surface facing a conductive portion exposed on a top surface of the flexible substrate, a projection protrudingly formed at one of the base member and the contact, a projection accommodating portion of recess shape disposed at the other of the base member and the contact and configured to accommodate the projection as sandwiching the flexible substrate therebetween, and a blade member configured to cut the flexible substrate at a position corresponding to the projection when the projection is accommodated in the projection accommodating portion with the flexible substrate being sandwiched therebetween.

15 Claims, 16 Drawing Sheets

CONNECTOR

BACKGROUND OF THE INVENTION

The present invention relates to a connector, particularly to a connector to be mounted on a flexible substrate in which a conductive portion is exposed at least on the top surface of the flexible substrate.

As a connector to be mounted on a flexible substrate, for example, JP 2005-63872 A discloses a connector 1 as shown in FIG. 37. The connector 1 is to be installed on a flat cable 2 and includes a base 3 and a cover 4 that are made of resin and make up a housing, a metallic plate 6 that is fitted in the base 3 and has a slot 5 formed therein, and a metallic connection portion 8 that has a piercing portion 7. The flat cable 2 is sandwiched between the base 3 and the cover 4 and, at the same time, in contact with a surface of the plate 6.

When the flat cable 2 is pierced with the piercing portion 7 of the connection portion 8 via a guide hole 4A of the cover 4, a flat conductor 9 in the flat cable 2 is sheared by the piercing portion 7, and with insertion of the piercing portion 7, a sheared portion of the flat conductor 9 is pressed into the slot 5 of the plate 6 together with the piercing portion 7 and comes into contact with the piercing portion 7 and serves as a fractured extension portion 9A. As a result, the connection portion 8 and the flat conductor 9 are electrically connected to each other.

Meanwhile, the flat conductor 9 is covered by an insulating material 10 of the flat cable 2 and, accordingly, when the flat cable 2 is pierced with the piercing portion 7 of the connection portion 8, the insulating material 10 is also sheared together with the flat conductor 9. Consequently, a sheared piece of the insulating material 10 may be caught between the piercing portion 7 and the flat conductor 9, resulting in a poor contact between the piercing portion 7 and the fractured extension portion 9A of the flat conductor 9. When such a poor contact occurs, the reliability of electrical connection between the connection portion 8 and the flat conductor 9 decreases.

SUMMARY OF THE INVENTION

The present invention has been made in order to solve the conventional problem described above and an object of the present invention is to provide a connector having excellent reliability in electrical connection with a conductive portion of a flexible substrate.

A connector according to a first invention is a connector to be mounted on a flexible substrate that has a top surface and a bottom surface facing in opposite directions to each other and has a conductive portion exposed at least on the top surface, the connector comprising:

a base member having a first surface facing the bottom surface of the flexible substrate;

a contact made of a conductive material and having a second surface facing the conductive portion exposed on the top surface of the flexible substrate;

a projection protrudingly formed at one of the base member and the contact;

a projection accommodating portion of recess shape disposed at the other of the base member and the contact and configured to accommodate the projection as sandwiching the flexible substrate therebetween; and a blade member configured to cut the flexible substrate at a position corresponding to the projection when the projection is accommodated in the projection accommodating portion with the flexible substrate being sandwiched therebetween, wherein the projection has a size in a thickness direction of the blade member larger than a thickness of the blade member, and wherein the first surface of the base member comes into contact with the bottom surface of the flexible substrate while the second surface of the contact comes into contact with the top surface of the flexible substrate, the contact is fixed to the base member with the projection being accommodated in the projection accommodating portion, and a cut-end-portion of the flexible substrate cut with the blade member is sandwiched between an outer surface of the projection and an inner surface of the projection accommodating portion, whereby the conductive portion comes into contact with the contact, so that the contact is electrically connected to the conductive portion.

A connector according to a second invention is a connector to be mounted on a flexible substrate that has a top surface and a bottom surface facing in opposite directions to each other and has a conductive portion exposed at least on the top surface, the connector comprising:

a base member having a first surface facing the bottom surface of the flexible substrate;

a contact made of a conductive material and having a second surface facing the conductive portion exposed on the top surface of the flexible substrate;

a housing to be fixed relative to the base member to thereby fix the contact to the base member;

a projection formed at one of the base member and the housing;

a projection accommodating portion of recess shape disposed at the other of the base member and the housing and configured to accommodate the projection as sandwiching the flexible substrate therebetween; and a blade member configured to cut the flexible substrate at a position corresponding to the projection when the projection is accommodated in the projection accommodating portion with the flexible substrate being sandwiched therebetween, wherein the projection has a size in a thickness direction of the blade member larger than a thickness of the blade member, wherein the contact has a flexible substrate connection portion that is inserted into the projection accommodating portion when the contact is fixed to the base member by means of the housing, and wherein the first surface of the base member comes into contact with the bottom surface of the flexible substrate while the second surface of the contact comes into contact with the top surface of the flexible substrate, the housing is fixed to the base member with the projection being accommodated in the projection accommodating portion, and a cut-end-portion of the flexible substrate cut with the blade member and the flexible substrate connection portion of the contact are sandwiched between an outer surface of the projection and an inner surface of the projection accommodating portion, whereby the conductive portion comes into contact with the flexible substrate connection portion of the contact, so that the contact is electrically connected to the conductive portion.

DETAILED DESCRIPTION OF THE INVENTION

Embodiments of the present invention are described below based on the appended drawings.

Embodiment 1

Figure 1:
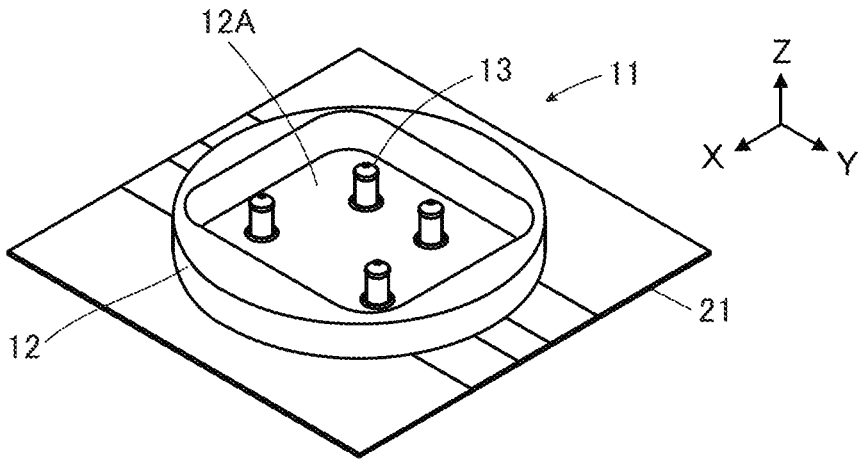
FIG. 1 is a perspective view showing a connector according to Embodiment 1 of the present invention.
Figure 2:
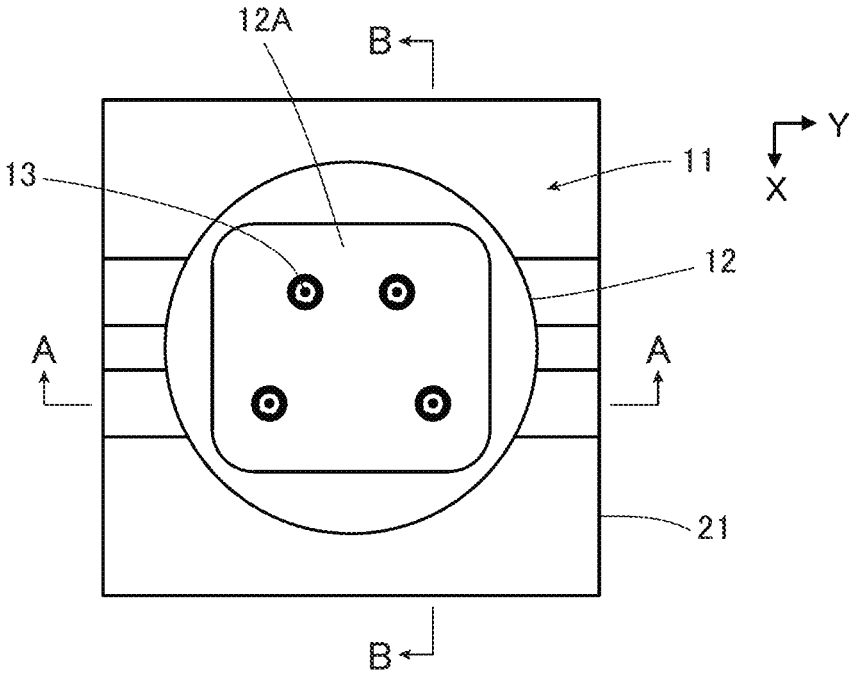
FIG. 2 is a plan view showing the connector according to Embodiment 1.

FIGS. 1 and 2 show a connector 11 according to Embodiment 1. The connector 11 is used as, for example, a garment-side connector part used for fitting a wearable device and is mounted on a flexible substrate 21.

The connector 11 includes a housing 12 disposed on the flexible substrate 21, and four contacts 13. The housing 12 has a recess 12A. The four contacts 13 project perpendicularly to the flexible substrate 21 within the recess 12A of the housing 12.

For convenience, the flexible substrate 21 is defined as extending along an XY plane, and the direction in which the contacts 13 project is referred to as "+Z direction."

Figure 3:
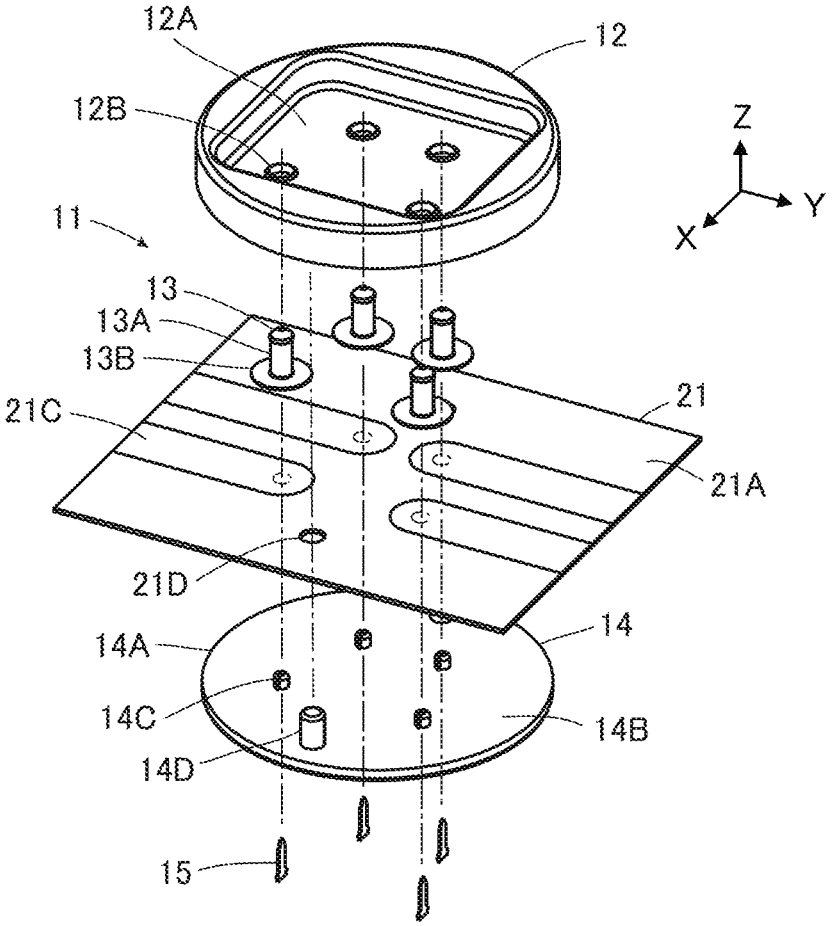
FIG. 3 is an exploded perspective view of the connector according to Embodiment 1 when viewed from obliquely above.
Figure 4:
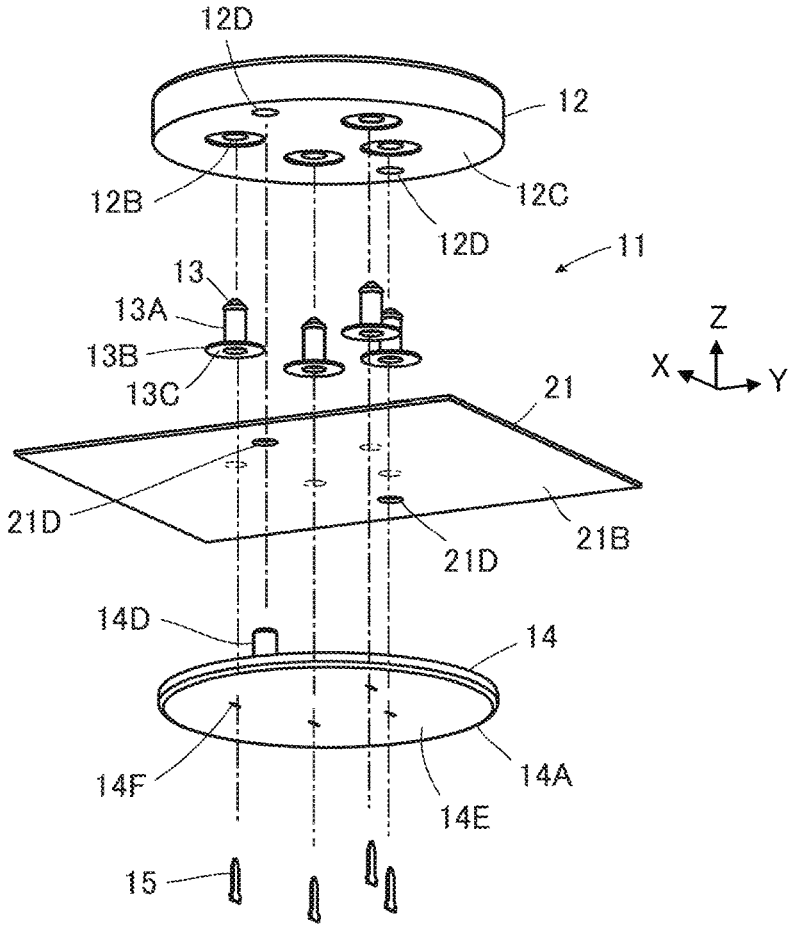
FIG. 4 is an exploded perspective view of the connector according to Embodiment 1 when viewed from obliquely below.

As shown in FIGS. 3 and 4, the connector 11 further includes a base member 14 disposed on the −Z direction side of the flexible substrate 21 and is mounted on the flexible substrate 21 as sandwiching the flexible substrate 21 between the housing 12 and the base member 14.

The flexible substrate 21 has a top surface 21A facing in the +Z direction and a bottom surface 21B facing in the −Z direction, and four flexible conductors 21C serving as conductive portions are exposed on the top surface 21A. The four flexible conductors 21C correspond to the four contacts 13 and each take on a strip shape extending in the Y direction.

The flexible substrate 21 is further provided with two through-holes 21D.

The housing 12 is made of an insulating material such as an insulating resin and is provided with four contact through-holes 12B in the recess 12A opening in the +Z direction. The four contact through-holes 12B separately correspond to the four contacts 13. Two recessed post accommodating portions 12D are formed at positions outside the recess 12A in the X direction and the Y direction and on a −Z direction-side surface 12C of the housing 12.

Each of the four contacts 13 is a plug-type contact made of a conductive material such as a metal and has a tubular portion 13A having a cylindrical shape extending in the Z direction and a flange 13B extending from a −Z directional end of the tubular portion 13A along an XY plane. The flange 13B has a second surface 13C facing in the −Z direction.

The base member 14 is made of an insulating material such as an insulating resin and has a flat plate portion 14A. The flat plate portion 14A has a first surface 14B facing in the +Z direction. Four projections 14C project on the first surface 14B. In addition, two housing fixing posts 14D project on the first surface 14B of the flat plate portion 14A.

The base member 14 is further provided with four slits 14F that separately extend from a surface 14E, facing in the −Z direction, of the flat plate portion 14A and penetrate the four projections 14C in the Z direction.

The connector 11 further includes four blade members 15 separately inserted in the four slits 14F of the base member 14.

As shown in FIGS. 3 and 4, the four contact through-holes 12B of the housing 12, the four flexible conductors 21C of the flexible substrate 21 and the four projections 14C of the base member 14 are arranged to correspond to each other in position.

Similarly, the two post accommodating portions 12D of the housing 12, the two through-holes 21D of the flexible substrate 21 and the two housing fixing posts 14D of the base member 14 are arranged to correspond to each other in position.

The through-holes 21D of the flexible substrate 21 have an inside diameter slightly larger than the outside diameter of the housing fixing posts 14D of the base member 14 to allow smooth insertion of the housing fixing posts 14D. Further, the post accommodating portions 12D of the housing 12 have an inside diameter slightly smaller than the outside diameter of the housing fixing posts 14D of the base member 14, and by press-fitting the housing fixing posts 14D into the post accommodating portions 12D, the housing 12 and the base member 14 are fixed to each other.

The contact through-holes 12B of the housing 12 have an inside diameter larger than the outside diameter of the tubular portions 13A of the contacts 13 and smaller than the outside diameter of the flanges 13B to allow smooth insertion of the tubular portions 13A of the contacts 13.

Figure 5:
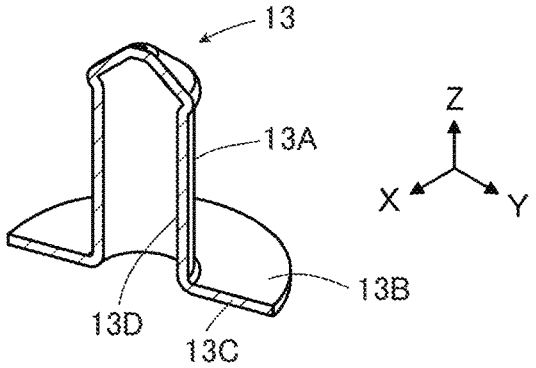
FIG. 5 is a perspective cross-sectional view showing a contact used in the connector according to Embodiment 1.

As shown in FIG. 5, the tubular portion 13A of the contact 13 has a cylindrical shape with its +Z directional end being closed, the flange 13B is formed integrally with the −Z directional end of the tubular portion 13A, and a projection accommodating portion 13D of recess shape is provided in the second surface 13C of the flange 13B facing in the −Z direction. Specifically, the projection accommodating portion 13D is formed inside the tubular portion 13A so as to have an opening end at the second surface 13C of the flange 13B.

The projection accommodating portion 13D of the contact 13 has an inside diameter smaller than a value obtained by adding a double of the sum of the thickness of the flexible substrate 21 at the portion where the flexible conductor 21C is exposed and the thickness of the flexible conductor 21C to the outside diameter of the projection 14C of the base member 14. The contact 13 as above can be manufactured by, for example, stamping a metal plate.

Figure 6:
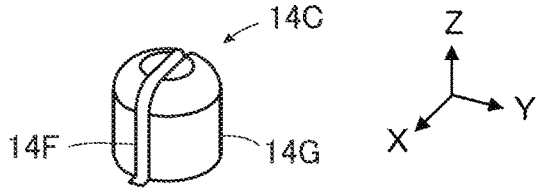
FIG. 6 is a perspective view showing a projection used in the connector according to Embodiment 1.

As shown in FIG. 6, the projection 14C of the base member 14 has a columnar shape extending in the Z direction and has outer surfaces 14G extending parallel to the direction in which the projection 14C projects. The projection 14C is divided into two parts, a +Y directional part and a −Y directional part, by the slit 14F formed along an XZ plane passing the central axis of the columnar shape.

Figure 7:
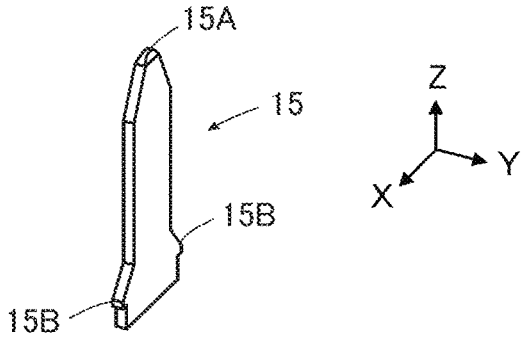
FIG. 7 is a perspective view showing a blade member used in the connector according to Embodiment 1.

As shown in FIG. 7, the blade member 15 is a flat plate member made of a metal material and extending along an XZ plane. The blade member 15 has, at its +Z directional end, a pointed portion 15A that is pointed in the +Z direction and also has, near its −Z directional end, a pair of protrusions 15B separately protruding in the +X and −X directions. The size of the blade member 15 in the Z direction is set to be larger than the total size, in the Z direction, of the flat plate portion 14A and the projection 14C of the base member 14. The pointed portion 15A is formed to be narrower in width in the X and Y directions as advancing in the +Z direction.

Figure 8:
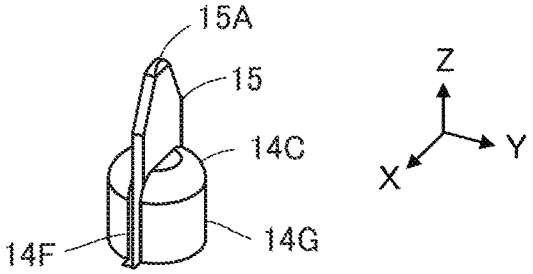
FIG. 8 is a perspective view showing the blade member fixed in the projection.

Before the operation of mounting the connector 11 to the flexible substrate 21, the four blade members 15 are attached to the base member 14. As shown in FIG. 4, the blade members 15 are inserted into the slits 14F opening at the surface 14E, facing in the −Z direction, of the flat plate portion 14A of the base member 14 from the −Z direction side. When the blade member 15 is inserted in the slit 14F up to the position where the −Z directional end of the blade member 15 is situated on the surface 14E, facing in the −Z direction, of the flat plate portion 14A of the base member 14, the pointed portion 15A of the blade member 15 projects from the projection 14C of the base member 14 in the +Z direction as shown in FIG. 8. In addition, the pair of protrusions 15B of the blade member 15 are press-fitted into the slit 14F, so that the blade member 15 is fixed relative to the projection 14C of the base member 14.

Note that the housing fixing posts 14D formed on the flat plate portion 14A of the base member 14 are higher than the pointed portions 15A of the blade members 15 projecting from the projections 14C in the +Z direction.

In mounting the connector 11 onto the flexible substrate 21, first, in FIGS. 3 and 4, the two housing fixing posts 14D of the base member 14 are separately inserted into the two through-holes 21D so as to project above the top surface 21A of the flexible substrate 21, the tubular portions 13A of the four contacts 13 are separately inserted into the four contact through-holes 12B of the housing 12 from the −Z direction side, and the tips of the two housing fixing posts 14D of the base member 14 projecting above the top surface 21A of the flexible substrate 21 are separately inserted into the two post accommodating portions 12D of the housing 12. As a result, the housing 12, the four contacts 13, the flexible substrate 21 and the base member 14 are aligned with each other in the X direction and the Y direction.

Since the housing fixing posts 14D of the base member 14 is higher than the blade members 15 projecting from the projections 14C, the housing fixing posts 14D are inserted into the through-holes 21D of the flexible substrate 21 without being affected by the presence of the projections 14C and the blade members 15.

In this state, when the housing 12 and the base member 14 are pressed in the Z direction so that they come close to each other, the −Z direction-side surface 12C of the housing 12 and the second surfaces 13C of the four contacts 13 facing in the −Z direction come into contact with the top surface 21A of the flexible substrate 21, and the pointed portions 15A of the blade members 15 projecting from the four projections 14C of the base member 14 in the +Z direction come into contact with the bottom surface 21B of the flexible substrate 21 such that the contacted portions of the flexible substrate 21 are pressed toward the inside of the projection accommodating portions 13D of the contacts 13 in the +Z direction.

Figure 9:
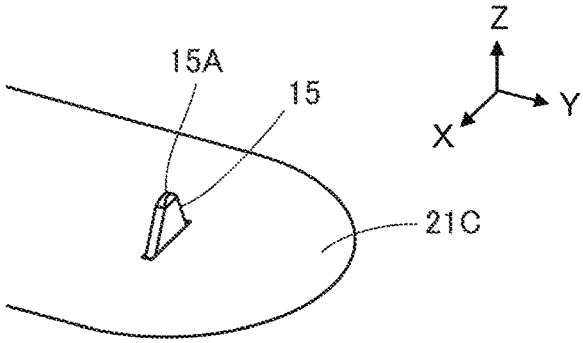
FIG. 9 is a perspective view showing a state where a flexible substrate is being cut with the blade member in Embodiment 1.
Figure 10:
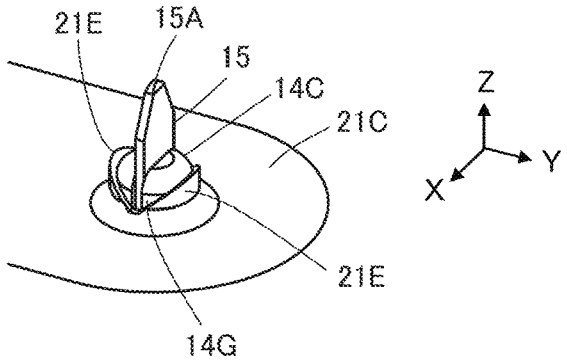
FIG. 10 is a perspective view showing the projection and the blade member that project from the flexible substrate.

As a result, the flexible substrate 21 and the flexible conductors 21C positioned on the +Z direction side of the projections 14C in a corresponding manner to the projections 14C are cut with the pointed portions 15A of the blade members 15 extending along an XZ plane as shown in FIG. 9, and then, as shown in FIG. 10, the projections 14C project on the +Z direction side of the flexible conductors 21C through the cut portions. Consequently, cut-end-portions 21E of the flexible substrate 21 are made to extend along the outer surfaces 14G of each projection 14 on the +Y and −Y direction sides.

Figure 11:
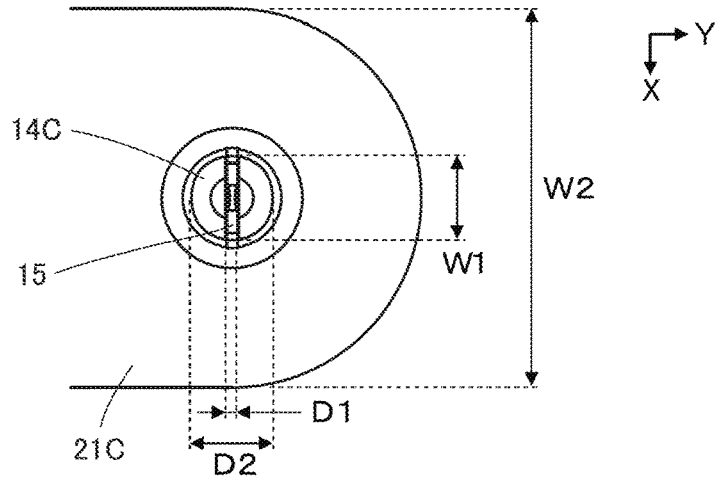
FIG. 11 is a plan view showing the projection and the blade member that project from the flexible substrate.

As shown in FIG. 11, the width W1 of the blade member 15 in the X direction is defined to be smaller than the width W2 of the flexible conductor 21C in the X direction. Since the blade member 15 is inserted in the slit 14F penetrating the projection 14C in the Z direction, the size D2 of the projection 14C in the Y direction that is the thickness direction of the blade member 15 is larger than the thickness D1 of the blade member 15.

Figure 12:
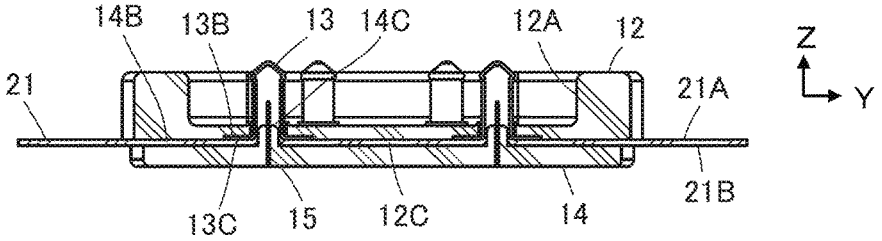
FIG. 12 is a cross-sectional view taken along line A-A in FIG. 2.
Figure 13:
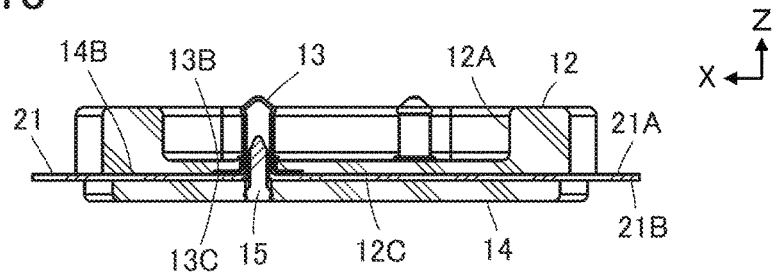
FIG. 13 is a cross-sectional view taken along line B-B in FIG. 2.

When the housing 12 and the base member 14 are further moved in the Z direction so that they come close to each other, as shown in FIGS. 12 and 13, the projections 14C of the base member 14 and the blade members 15 are inserted into the insides of the corresponding contacts 13, which allows the first surface 14B of the base member 14 facing in the +Z direction to come into contact with the bottom surface 21B of the flexible substrate 21.

Since the contact through-holes 12B of the housing 12 have an inside diameter larger than the outside diameter of the tubular portions 13A of the contacts 13 and smaller than the outside diameter of the flanges 13B, the flange 13B of each contact 13 is sandwiched between the −Z direction-side surface 12C of the housing 12 and the top surface 21A of the flexible substrate 21, whereby the contacts 13 are fixed relative to the base member 14. Further, the housing 12 and the base member 14 are fixed to each other by press-fitting the two housing fixing posts 14D of the base member 14 into the two post accommodating portions 12D of the housing 12, and thus the mounting of the connector 11 onto the flexible substrate 21 is completed.

Figure 14:
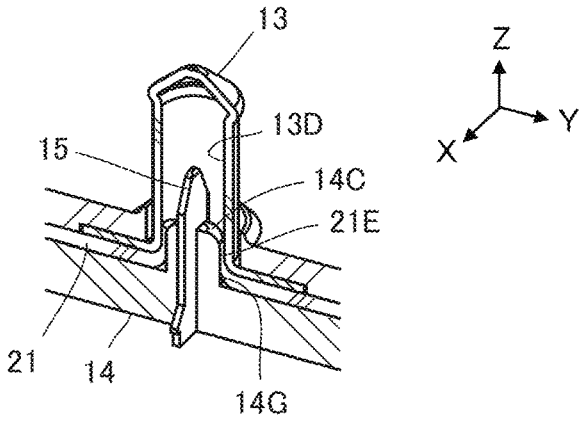
FIG. 14 is a cutaway perspective view showing a main part of the connector according to Embodiment 1.
Figure 15:
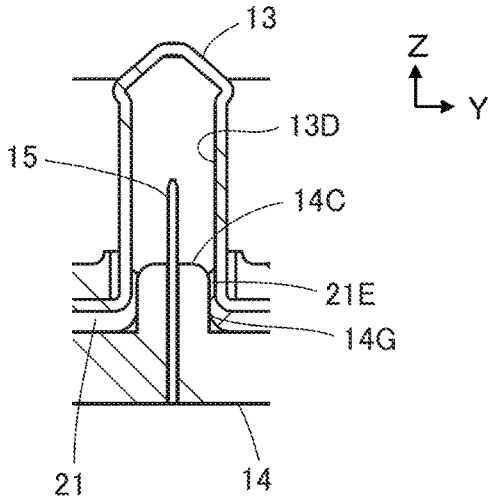
FIG. 15 is an enlarged view of a main part of FIG. 12.
Figure 16:
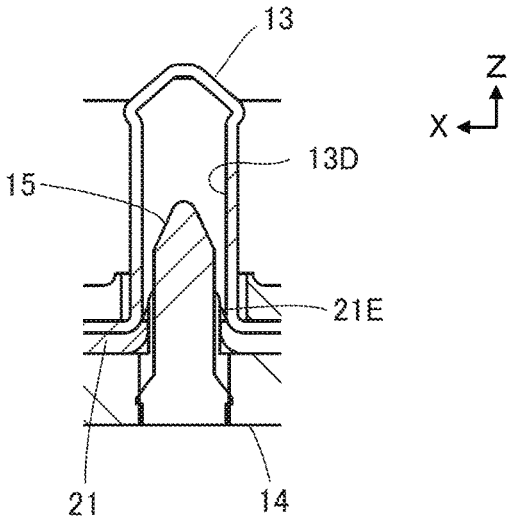
FIG. 16 is an enlarged view of a main part of FIG. 13.

At this time, since, as shown in FIG. 10, the cut-end-portions 21E of the flexible substrate 21 extend in the +Z direction along the outer surfaces 14G of the projection 14, as shown in FIGS. 14 to 16, the projection 14C is inserted into the projection accommodating portion 13D with the cut-end-portions 21E of the flexible substrate 21 being sandwiched between the outer surfaces 14G of the projection 14C and the inner surface of the projection accommodating portion 13D. Accordingly, the inner surface of the projection accommodation portion 13D of the contact 13 comes into contact with the flexible conductor 21C at the cut-end-portions 21E.

As described above, the projection accommodating portion 13D of the contact 13 has an inside diameter smaller than a value obtained by adding a double of the sum of the thickness of the flexible substrate 21 at the portion where the flexible conductor 21C is exposed and the thickness of the flexible conductor 21C to the outside diameter of the projection 14C of the base member 14, and therefore, the flexible conductor 21C at the cut-end-portions 21E is pressed by the projection 14C against the inner surface of the projection accommodating portion 13D of the contact 13 such that a contact pressure is applied thereto, whereby the contact 13 is electrically connected to the flexible conductor 21C.

Thus, the flexible substrate 21 and the flexible conductor 21C are cut by means of the blade member 15 fixed relative to the projection 14C of the base member 14, and the cut-end-portions 21E of the flexible substrate 21 are sandwiched between the outer surfaces 14G of the projection 14C and the projection accommodating portion 13D of the contact 13. Owing to this configuration, even when the flexible substrate 21 is made of a material that is not so elastically stretchable, the contact 13 can be electrically connected to the flexible conductor 21C of the flexible substrate 21 without fail.

In addition, the connector 11 can be easily mounted on the flexible substrate 21 merely by moving the housing 12 and the base member 14 so that they come close to each other as sandwiching the flexible substrate 21 therebetween.

In addition, since the base member 14 includes the two housing fixing posts 14D that are higher than the pointed portions 15A of the blade members 15 projecting from the projections 14C of the base member 14 in the +Z direction, by inserting those housing fixing posts 14D separately into the two through-holes 21D of the flexible substrate 21 and then the two post accommodating portions 12D of the housing 12, the housing 12, the four contacts 13, the flexible substrate 21 and the base member 14 can be aligned with each other in the X direction and the Y direction while their shifting is limited, thereby further facilitating the mounting work of the connector 11 onto the flexible substrate 21.

While the four contacts 13 are used, it suffices if the connector has at least one contact 13. Regardless of the number of the contacts 13, all of the contacts 13 can be simultaneously fitted into the corresponding projections 14C of the base member 14 by pressing the housing 12 and the base member 14 so that they come close to each other as sandwiching the flexible substrate 21 therebetween, and therefore, even when the connector 11 is a multi-contact connector having a plurality of contacts 13, it is possible to achieve easy mounting and reliable electrical connection.

While the contact 13 is fixed relative to the base member 14 by sandwiching the flange 13B of the contact 13 between the housing 12 and the base member 14, the invention is not limited thereto, and the contact 13 may be fixed to the base member 14 by any of other known methods such as screwing and press-fitting.

While the housing 12 and the base member 14 are mutually fixed by press-fitting the housing fixing posts 14D of the base member 14 into the post accommodating portions 12D of the housing 12, this assembling technique is merely an example, and the invention is not limited thereto. For example, the housing 12 can be fixed to the base member 14 by any of other methods such as screwing and adhering.

Since the base member 14 does not come into direct contact with the contacts 13 or the flexible conductors 21C of the flexible substrate 21, the base member 14 may be made of a conductive material such as metal instead of an insulating material.

For the flexible substrate 21 on which the connector 11 is mounted, use is made of a flexible substrate having the top surface 21A on which the flexible conductors 21C serving as conductive portions are exposed and the bottom surface 21B on which no conductive portion is exposed; however, the invention is not limited thereto, and it suffices if a flexible substrate for use is configured such that a conductive portion is exposed at least on its top surface. Accordingly, a fabric having a top surface coated with a conductive layer, a fabric in which conductive fibers are woven, and other fabrics may be used as a flexible substrate on which the connector 11 is mounted.

While the outer surfaces 14G of the projection 14C of the base member 14 extend parallel to the direction in which the projection 14C projects, the invention is not limited thereto, and the projection 14C may taper in the +Z direction to a certain extent as long as the projection accommodating portion 13D has an inside diameter smaller than a value obtained by adding a double of the sum of the thickness of the flexible substrate 21 at the portion where the flexible conductor 21C is exposed and the thickness of the flexible conductor 21C to the outside diameter of the projection 14C of the base member 14.

Figure 17:
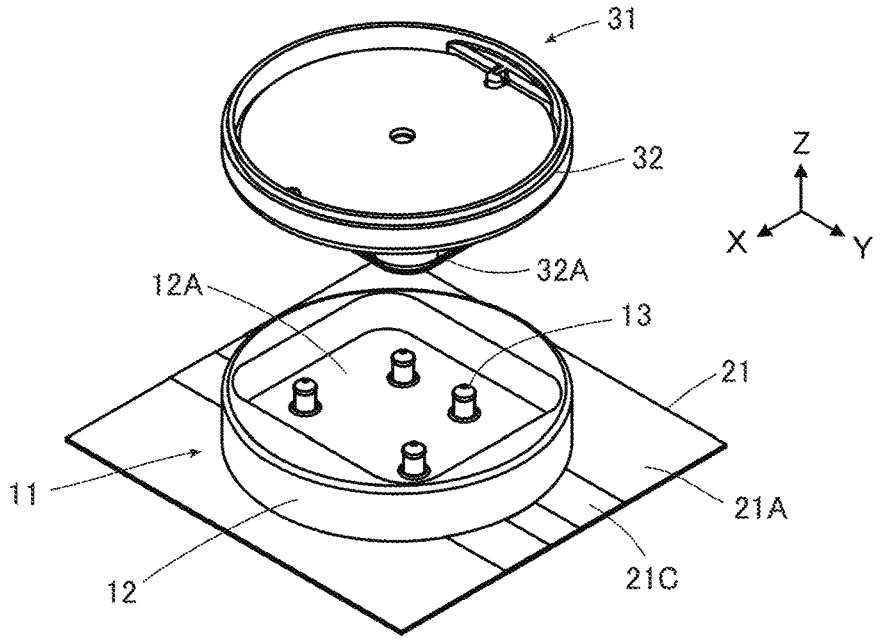
FIG. 17 is a perspective view of the connector according to Embodiment 1 and a counter connector in a non-fitted state when viewed from obliquely above.
Figure 18:
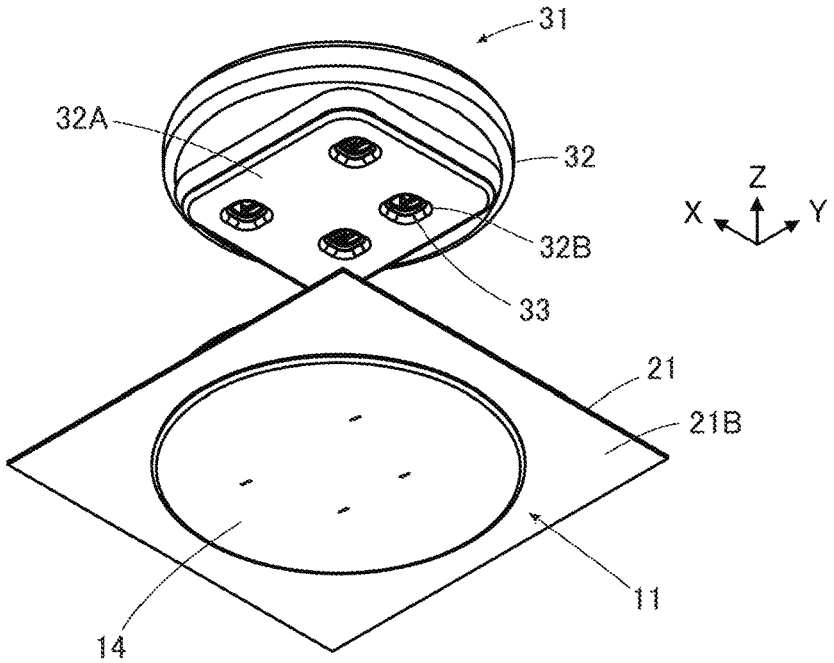
FIG. 18 is a perspective view of the connector according to Embodiment 1 and the counter connector in the non-fitted state when viewed from obliquely below.

FIGS. 17 and 18 show the state where the connector 11 mounted on the flexible substrate 21 is aligned with an electronic device module 31 which is a counter connector.

The electronic device module 31 has a housing 32 made of an insulating material such as an insulating resin, and four contacts 33 disposed inside the housing 32. The contacts 33 are each a contact having a spring contact point.

The housing 32 has a raised portion 32A protruding in the −Z direction, and four openings 32B corresponding to the four contacts 33 are formed in the raised portion 32A. The four contacts 33 are exposed through the corresponding openings 32B of the housing 32.

The raised portion 32A of the housing 32 and the four contacts 33 are arranged so as to respectively correspond to the recess 12A of the housing 12 and the four contacts 13 in the connector 11 in position in an XY plane, and the raised portion 32A of the housing 32 has a shape and size allowing its insertion into the recess 12A of the housing 12 of the connector 11.

By fitting the electronic device module 31 as above into the connector 11, each of the four contacts 13 of the connector 11 is electrically connected to the corresponding contact 33 of the electronic device module 31.

When the connector 11 is configured as a garment-side connector part to be attached to a garment, the electronic device module 31 is usable as a wearable device to be connected to the garment-side connector part.

Embodiment 2

Figure 19:
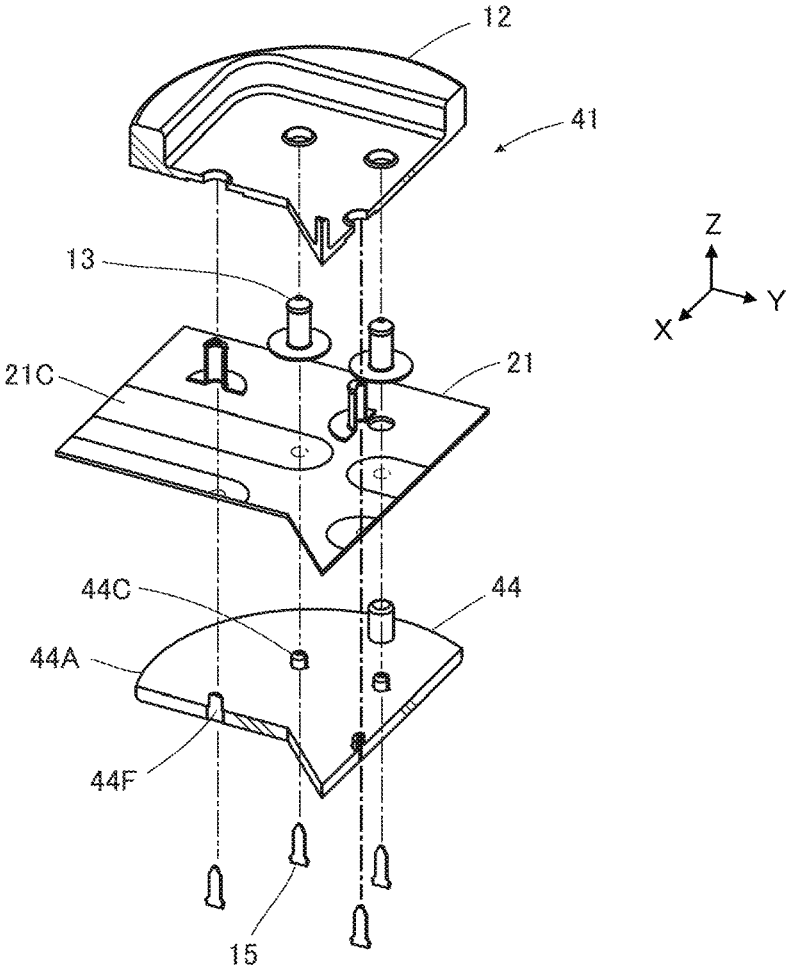
FIG. 19 is an exploded cutaway perspective view of a connector according to Embodiment 2.

In Embodiment 1, while the flexible substrate 21 has the flexible conductors 21C of strip shape extending in the Y direction, the blade members 15 have a flat plate shape extending along an XZ plane; however, the invention is not limited thereto. For instance, while the flexible conductors 21C have a strip shape extending in the Y direction, the blade members 15 may have a flat plate shape extending along a YZ plane, as in a connector 41 shown in FIG. 19. In this case, it is necessary to use, instead of the base member 14 used in Embodiment 1, a base member 44 in which slits 44F extending along a YZ plane according to the orientation of the blade members 15 are formed in a flat plate portion 44A and projections 44C.

Since the direction in which the blade member 15 extends and the direction in which the flexible conductor 21C extends are made the same, the flexible conductor 21C is to be cut with the blade member 15 in a direction in which the flexible conductor 21C extends. Therefore, even when the blade member 15 and the flexible conductor 21C are displaced relative to each other due to the given assembly tolerance or another reason, or even when the width W2 of the flexible conductor 21C shown in FIG. 11 is narrower, a cut portion can be placed within the flexible conductor 21C, establishing the electrical connection between the contact 13 and the flexible conductor 21C without fail.

Thus, even when many flexible conductors 21C are densely disposed on the flexible substrate 21 and the width W2 of each flexible conductor 21C is narrower accordingly, it is possible to construct a reliable connector 41.

Embodiment 3

Figure 20:
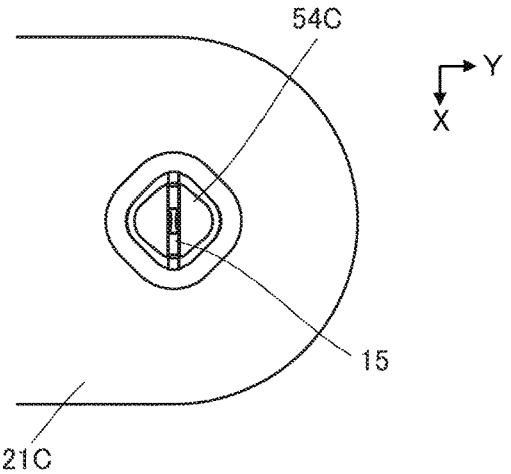
FIG. 20 is a plan view showing a projection and a blade member that project from a flexible substrate in Embodiment 3.
Figure 21:
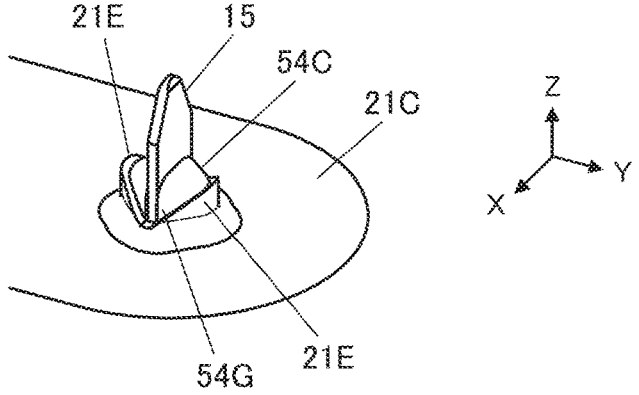
FIG. 21 is a perspective view showing a state where the projection projects through a cut flexible substrate in Embodiment 3.

While, in Embodiment 1, the projection 14C of the base member 14 has a cylindrical shape extending in the Z direction, the invention is not limited thereto. As shown in FIG. 20, use may be made of a projection having a columnar shape with a rectangular, for example, rhombus cross section in an XY plane. Also in this case, as shown in FIG. 21, the flexible substrate 21 and the flexible conductor 21C are cut with the blade member 15 fixed relative to a projection 54C, and the projection 54C is made to project on the +Z direction side of the flexible conductor 21C. Consequently, the state where the cut-end-portions 21E of the flexible substrate 21 extend in the +Z direction along outer surfaces 54G of the projection 54 can be established.

The projection 54C has a size in the Y direction that is the thickness direction of the blade member 15 larger than the thickness of the blade member 15.

Thus, as with Embodiment 1, a connector having excellent reliability in electrical connection with the flexible conductor 21C of the flexible substrate 21 can be obtained.

It is preferable for the projection 54C to have the shape of rectangle with rounded corners in an XY plane, as shown in FIG. 20. This is because the contact area between the cut-end-portions 21E of the flexible substrate 21 pressed by the projection 54C against the inner surface of the projection accommodating portion 13D of the contact 13 and the inner surface of the projection accommodating portion 13D becomes larger, which leads to smaller contact resistance between the flexible conductor 21C and the contact 13.

Embodiment 4

Figure 22:
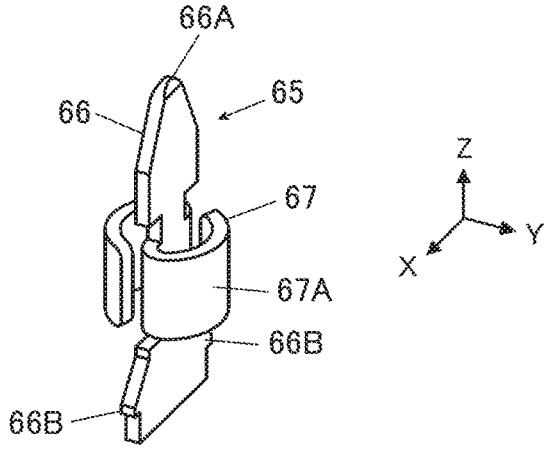
FIG. 22 is a perspective view showing a blade member used in a connector according to Embodiment 4.

While, in Embodiment 1, the projection 14C is formed at the base member 14, a blade member 65 that is made of metal and obtained by integrally forming a blade portion 66 and a projection 67 as shown in FIG. 22 may be used.

The blade portion 66 has a flat plate shape extending along an XZ plane and includes a pointed portion 66A and a pair of protrusions 66B, as with the blade member 15 in Embodiment 1. The projection 67 is obtained by curving a pair of arm portions separately extending from the +X and −X directional ends of the blade portion 66 and has outer surfaces 67A together forming a cylindrical shape extending in the Z direction. The blade member 65 as above can be formed by bending a single metal sheet.

The projection 67 has a size in the Y direction that is the thickness direction of the blade portion 66 larger than the thickness of the blade portion 66.

Figure 23:
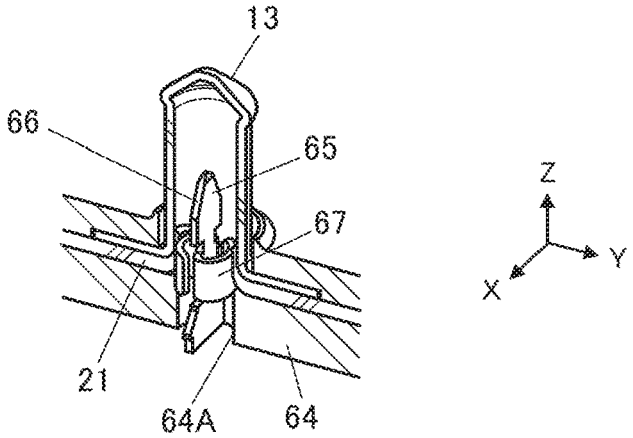
FIG. 23 is a cutaway perspective view showing a main part of the connector according to Embodiment 4.
Figure 24:
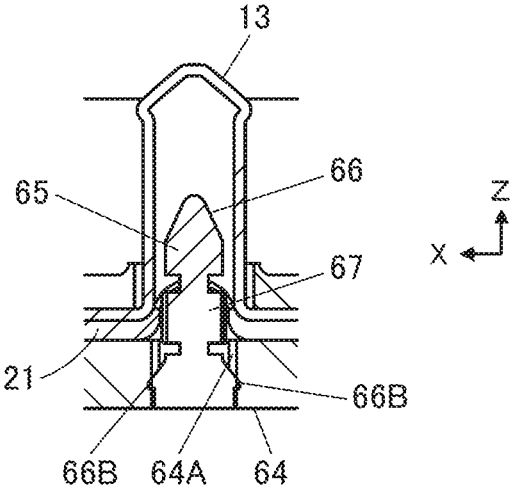
FIG. 24 is a cross-sectional view showing the main part of the connector according to Embodiment 4.

As shown in FIGS. 23 and 24, a base member 64 used in Embodiment 4 has, instead of the projection 14C, a through-hole 64A penetrating in the Z direction, and the blade member 65 is fixed relative to the base member 64 when the blade member 65 is passed through the through-hole 64A and the pair of protrusions 66B of the blade portion 66 are press-fitted into the through-hole 64A.

The projection accommodating portion 13D of the contact 13 has an inside diameter smaller than a value obtained by adding a double of the sum of the thickness of the flexible substrate 21 at the portion where the flexible conductor 21C is exposed and the thickness of the flexible conductor 21C to the outside diameter of the projection 67 of the blade member 65.

Figure 25:
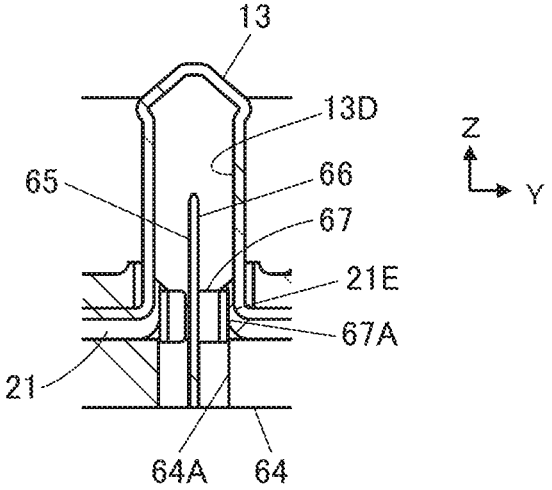
FIG. 25 is a cross-sectional view showing the main part of the connector according to Embodiment 4.

When the housing 12 and the base member 64 are moved so that they come close to each other as sandwiching the flexible substrate 21 therebetween, the blade portion 66 of the blade member 65 cuts the flexible substrate 21 and the flexible conductor 21C, and the cut-end-portions 21E of the flexible substrate 21 are sandwiched between the outer surfaces 67A of the projection 67 and the projection accommodating portion 13D of the contact 13 as shown in FIG. 25.

As described above, the projection accommodating portion 13D of the contact 13 has an inside diameter smaller than a value obtained by adding a double of the sum of the thickness of the flexible substrate 21 at the portion where the flexible conductor 21C is exposed and the thickness of the flexible conductor 21C to the outside diameter of the projection 67 of the blade member 65, and accordingly, the flexible conductor 21C at the cut-end-portions 21E is pressed by the projection 67 against the inner surface of the projection accommodating portion 13D of the contact 13 such that a contact pressure is applied thereto, whereby the contact 13 is electrically connected to the flexible conductor 21C.

Thus, as with Embodiment 1, a connector having excellent reliability in electrical connection with the flexible conductor 21C of the flexible substrate 21 can be obtained.

Embodiment 5

Figure 26:
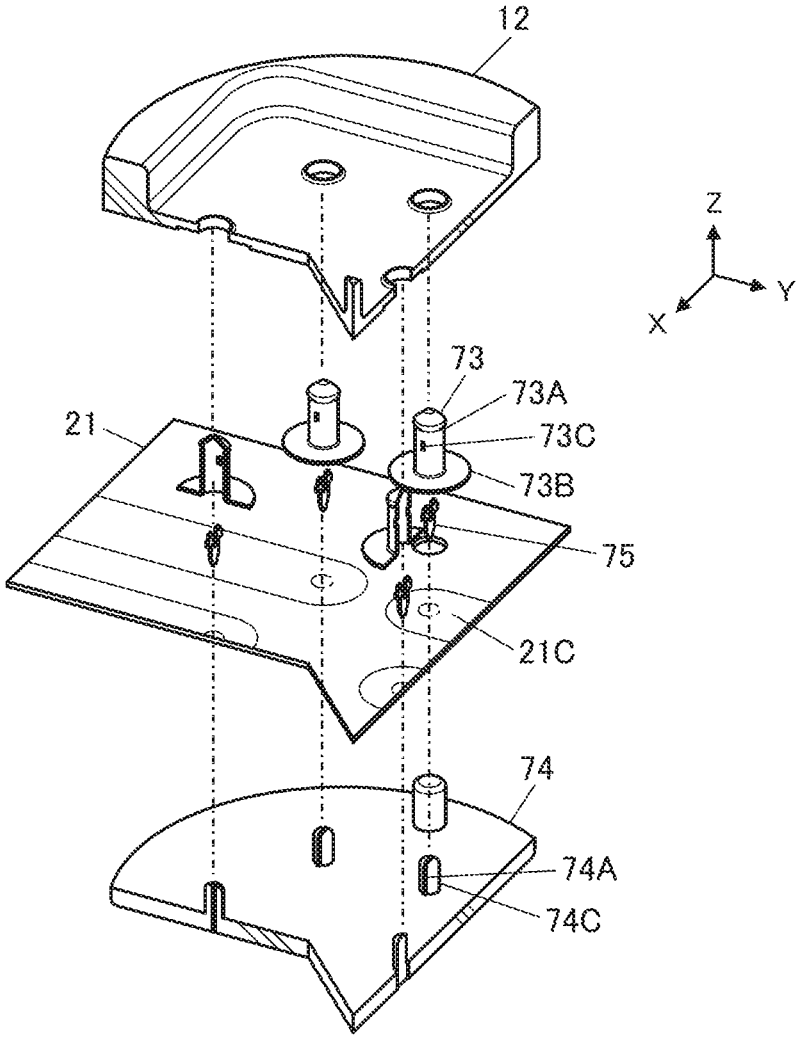
FIG. 26 is an exploded cutaway perspective view of a connector according to Embodiment 5.
Figure 27:
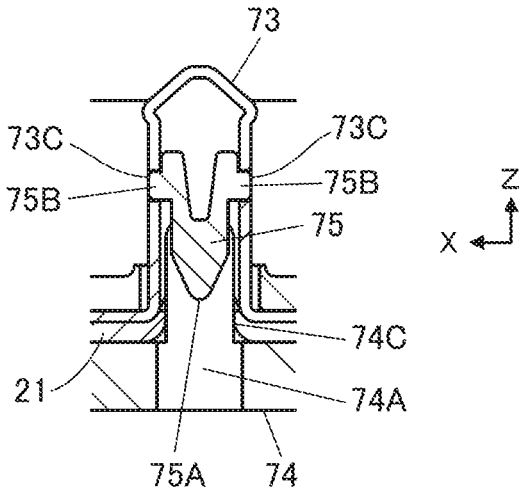
FIG. 27 is a cross-sectional view showing a main part of the connector according to Embodiment 5.
Figure 28:
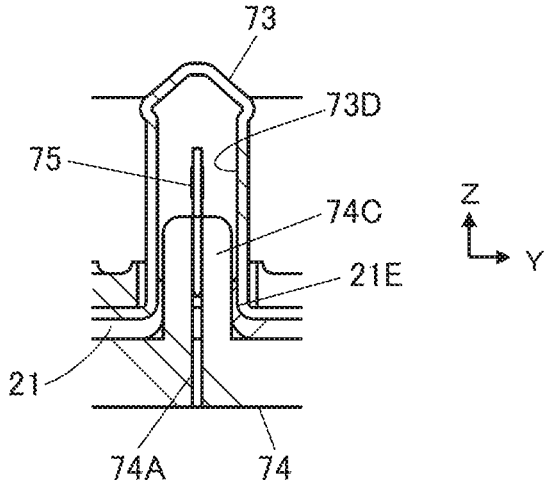
FIG. 28 is a cross-sectional view showing the main part of the connector according to Embodiment 5.

While, in Embodiment 1, the blade members 15 are fixed relative to the projections 14C of the base member 14, as shown in FIGS. 26 to 28, a connector may be configured such that b4lade members 75 are fixed to contacts 73.

As with the contacts 13 in Embodiment 1, each contact 73 has a tubular portion 73A of cylindrical shape extending in the Z direction and a flange 73B extending from a −Z directional end of the tubular portion 73A along an XY plane. The tubular portion 73A is provided with a pair of attachment holes 73C separately facing in the +X and −X directions.

The blade member 75 is a flat plate member made of a metal material and extending along an XZ plane, as with the blade member 15 in Embodiment 1. However, the blade member 75 has, at its −Z directional end, a pointed portion 75A that is pointed in the −Z direction and also has, near its +Z directional end, a pair of protrusions 75B separately protruding in the +X and −X directions in an opposite manner to the blade member 15 in Embodiment 1. The pair of protrusions 75B of the blade member 75 are fitted into the pair of attachment holes 73C of the contact 73, whereby the blade member 75 is fixed to the inside of a projection accommodating portion 73D of the contact 73.

A base member 74 used in Embodiment 5 has projections 74C of columnar shape extending in the Z direction and is provided with blade member accommodating grooves 74A each extending along an XZ plane passing through the central axis of the corresponding projection 74C. The pointed portion 75A is situated inside the projection accommodating portion 73D.

The projection 74C has a size in the Y direction that is the thickness direction of the blade member 75 larger than the thickness of the blade member 75.

The projection accommodating portion 73D of the contact 73 has an inside diameter smaller than a value obtained by adding a double of the sum of the thickness of the flexible substrate 21 at the portion where the flexible conductor 21C is exposed and the thickness of the flexible conductor 21C to the outside diameter of the projection 74C of the base member 74.

When the housing 12 and the base member 74 are moved so that they come close to each other as sandwiching the flexible substrate 21 therebetween, the blade member 75 cuts the flexible substrate 21 and the flexible conductor 21C at positions corresponding to the projections 74C of the base member 74. The cut-end-portions 21E of the flexible substrate 21 are sandwiched between the outer surfaces of the projection 74C of the base member 74 and the inner surface of the projection accommodating portion 73D of the contact 73.

As described above, the projection accommodating portion 73D of the contact 73 has an inside diameter smaller than a value obtained by adding a double of the sum of the thickness of the flexible substrate 21 at the portion where the flexible conductor 21C is exposed and the thickness of the flexible conductor 21C to the outside diameter of the projection 74C of the base member 74, and accordingly, the flexible conductor 21C at the cut-end-portions 21E is pressed by the projection 74C against the inner surface of the projection accommodating portion 73D of the contact 73 such that a contact pressure is applied thereto, whereby the contact 73 is electrically connected to the flexible conductor 21C.

Thus, as with Embodiment 1, a connector having excellent reliability in electrical connection with the flexible conductor 21C of the flexible substrate 21 can be obtained. In addition, since the blade member 75 including the pointed portion 75A is accommodated in the projection accommodating portion 73D of the contact 73, the operation of mounting the connector to the flexible substrate 21 can be safely carried out. The pointed portion 75A may be disposed so as to project from the projection accommodating portion 73D in a direction toward the flexible substrate 21.

As shown in FIG. 27, the pointed portion 75A of the blade member 75 that has cut the flexible substrate 21 and the flexible conductor 21C is accommodated within the blade member accommodating groove 74A of the projection 74C.

Embodiment 6

Figure 29:
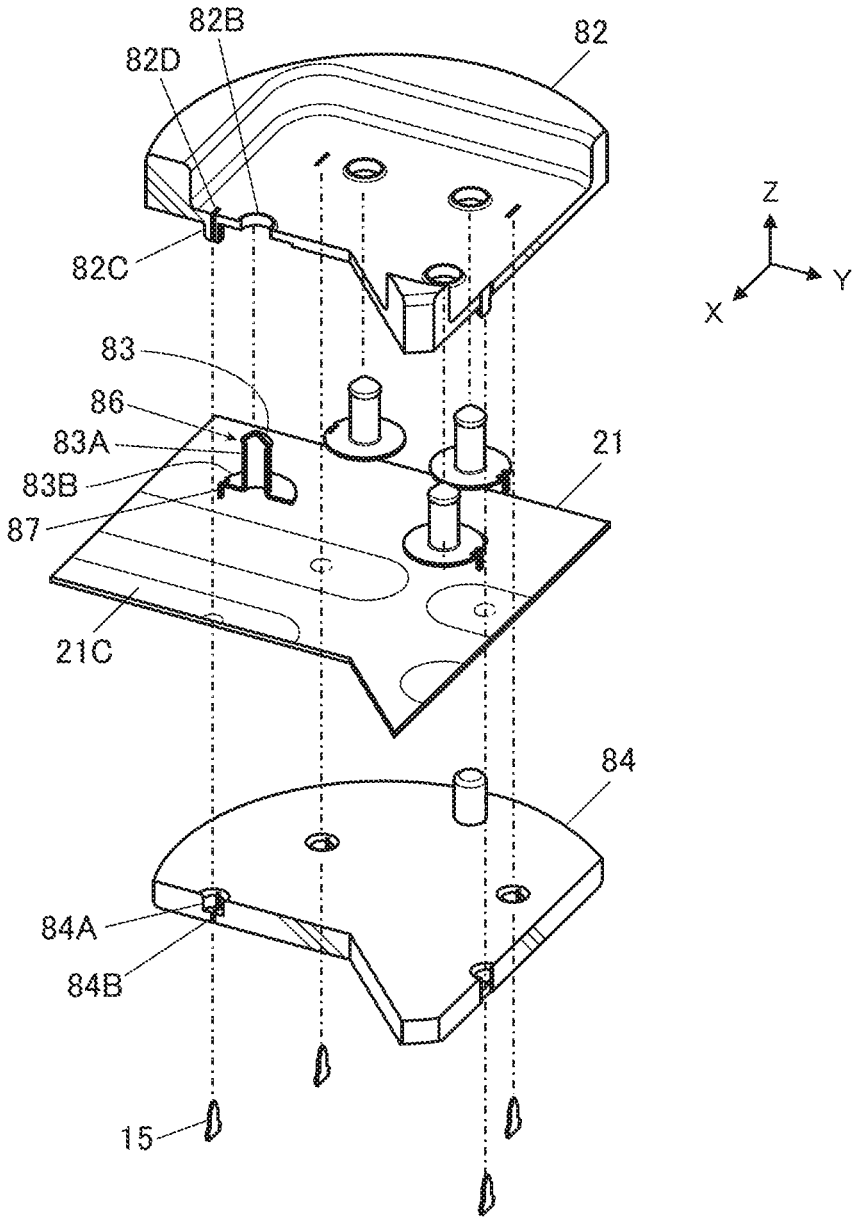
FIG. 29 is an exploded cutaway perspective view of a connector according to Embodiment 6.

In Embodiment 1, the projections 14C of the base member 14 are inserted in the projection accommodating portions 13D of the contacts 13; however, another configuration may be employed in which, as shown in FIG. 29, a housing 82 is provided with projections 82C while a base member 84 is provided with projection accommodating portions 84A of recess shape, and the projections 82C are inserted into the projection accommodating portions 84A.

The projections 82C of the housing 82 are disposed near contact through-holes 82B and each have a columnar shape projecting in the −Z direction. Blade member accommodating grooves 82D are formed at the housing 82 so as to each extend along an XZ plane passing through the central axis of the corresponding projection 82C.

Each projection accommodating portion 84A of the base member 84 opens toward the +Z direction and has a slit 84B penetrating the bottom of the projection accommodating portion 84A in the Z direction. The blade member 15 is press-fitted into the slit 84B from the −Z direction side and thereby fixed to the projection accommodating portion 84A of the base member 84.

The projection 82C of the housing 82 has a size in the Y direction that is the thickness direction of the blade member 15 larger than the thickness of the blade member 15.

In Embodiment 6, contact members 86 are used. The contact members 86 each have a contact 83 and a flexible substrate connection portion 87 integrally connected to the contact 83. As with the contact 13 in Embodiment 1, the contact 83 has a tubular portion 83A of cylindrical shape extending in the Z direction and a flange 83B extending from a −Z directional end of the tubular portion 83A along an XY plane. The flexible substrate connection portion 87 is connected to an edge of the flange 83B of the contact 83 and bends from the edge of the flange 83B to extend in the −Z direction.

The contact member 86 is configured such that, when the tubular portion 83A of the contact 83 is inserted in the contact through-hole 82B of the housing 82, the flexible substrate connection portion 87 extends in the −Z direction along the outer surfaces of the projection 82C of the housing 82.

The projection accommodating portion 84A of the base member 84 has an inside diameter smaller than a value obtained by adding: the outside diameter of the projection 82C of the housing 82; a double of the sum of the thickness of the flexible substrate 21 at the portion where the flexible conductor 21C is exposed and the thickness of the flexible conductor 21C; and the thickness of the flexible substrate connection portion 87.

Figure 30:
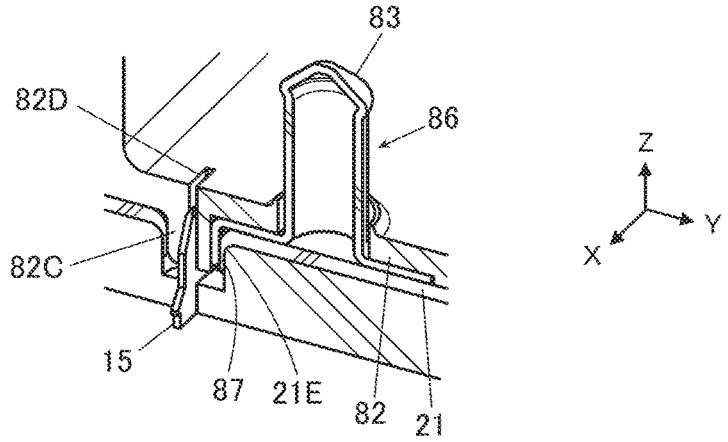
FIG. 30 is a cutaway perspective view showing a main part of the connector according to Embodiment 6.
Figure 31:
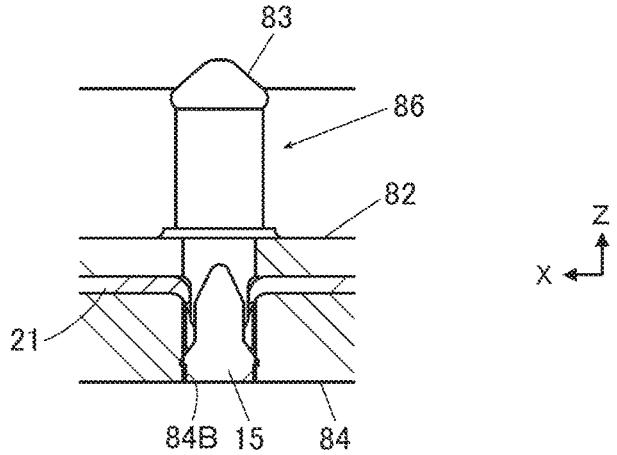
FIG. 31 is a cross-sectional front view showing the connector according to Embodiment 6.
Figure 32:
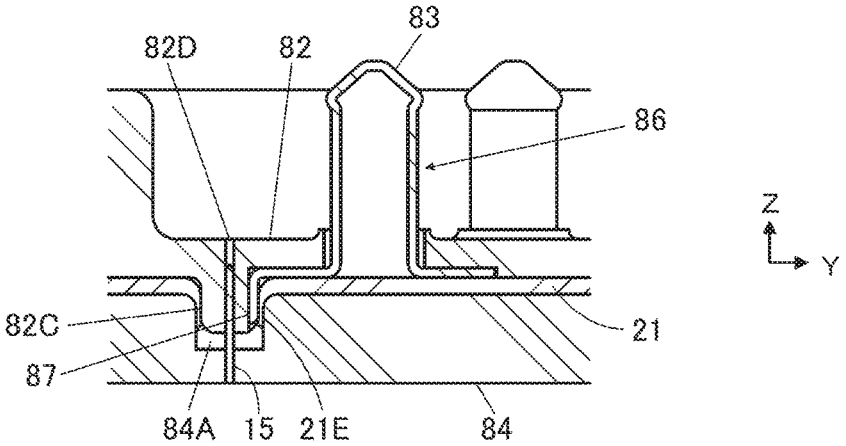
FIG. 32 is a cross-sectional side view showing the connector according to Embodiment 6.

When the housing 82 and the base member 84 are moved so that they come close to each other as sandwiching the flexible substrate 21 therebetween, as shown in FIGS. 30 to 32, the projection 82C of the housing 82 is inserted into the projection accommodating portion 84A of the base member 84, and the flexible substrate 21 and the flexible conductor 21C are cut with the blade member 15 fixed inside the projection accommodating portion 84A. At this time, since the flexible substrate connection portion 87 of the contact member 86 lies along the outer surfaces of the projection 82C of the housing 82, the cut-end-portions 21E of the flexible substrate 21 and the flexible substrate connection portion 87 of the contact member 86 are sandwiched between the outer surfaces of the projection 82C of the housing 82 and the inner surface of the projection accommodating portion 84A of the base member 84, and the flexible conductor 21C of the flexible substrate 21 comes into contact with the flexible substrate connection portion 87 of the contact member 86.

As described above, the projection accommodating portion 84A of the base member 84 has an inside diameter smaller than a value obtained by adding: the outside diameter of the projection 82C of the housing 82; a double of the sum of the thickness of the flexible substrate 21 at the portion where the flexible conductor 21C is exposed and the thickness of the flexible conductor 21C; and the thickness of the flexible substrate connection portion 87. Accordingly, the flexible conductor 21C at the cut-end-portions 21E is pressed by the projection 82C against a surface of the flexible substrate connection portion 87 such that a contact pressure is applied thereto, whereby the contact member 86 is electrically connected to the flexible conductor 21C.

Thus, as with Embodiment 1, a connector having excellent reliability in electrical connection with the flexible conductor 21C of the flexible substrate 21 can be obtained.

As shown in FIG. 30, the pointed portion 15A of the blade member 15 that has cut the flexible substrate 21 and the flexible conductor 21C is accommodated within the blade member accommodating groove 82D of the housing 82.

Embodiment 7

Figure 33:
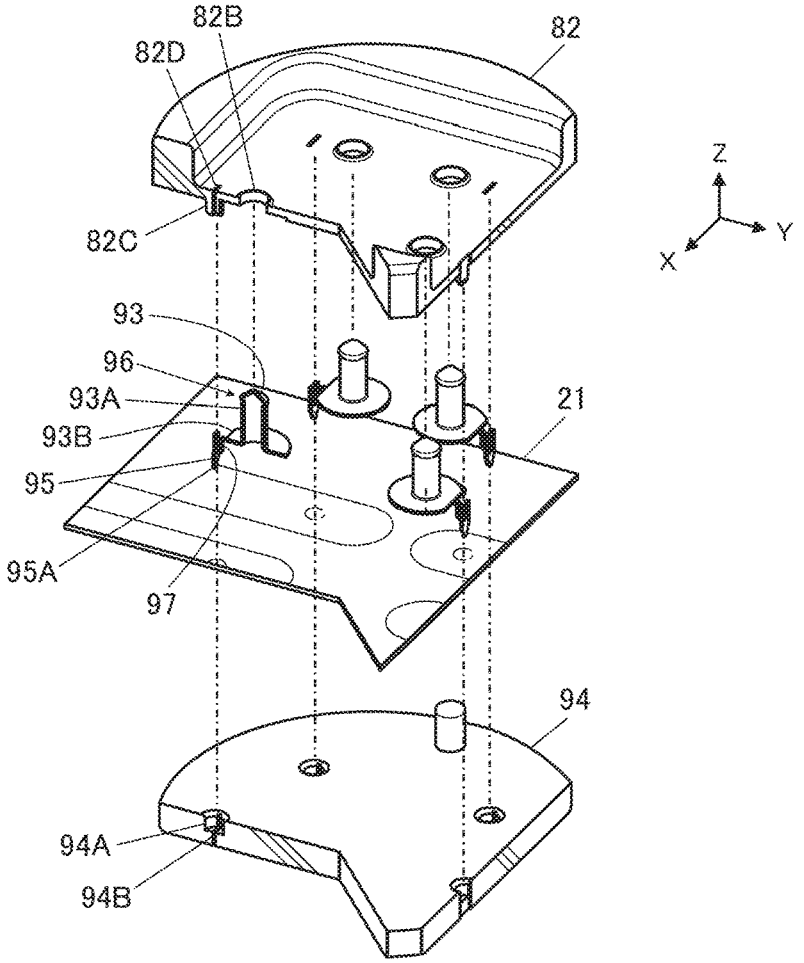
FIG. 33 is an exploded cutaway perspective view of a connector according to Embodiment 7.

While, in Embodiment 6, the blade member 15 used to cut the flexible substrate 21 and the flexible conductor 21C is fixed inside the projection accommodating portion 84A of the base member 84, the invention is not limited thereto, and as shown in FIG. 33, the connector may be configured such that a contact member 96 has a blade member 95.

The housing 82 is identical to the housing 82 used in Embodiment 6. Specifically, the projections 82C of columnar shape projecting in the −Z direction are formed near the contact through-holes 82B, and the blade member accommodating grooves 82D are formed at the housing 82 so as to each extend along an XZ plane passing through the central axis of the corresponding projection 82C.

The projection 82C of the housing 82 has a size in the Y direction that is the thickness direction of the blade member 95 larger than the thickness of the blade member 95.

The contact member 96 has a contact 93, a flexible substrate connection portion 97 connected to the contact 93, and the blade member 95 connected to the flexible substrate connection portion 97. As with the contact 83 in Embodiment 6, the contact 93 has a tubular portion 93A of cylindrical shape extending in the Z direction and a flange 93B extending from a −Z directional end of the tubular portion 93A along an XY plane. As with the flexible substrate connection portion 87 in Embodiment 6, the flexible substrate connection portion 97 is connected to an edge of the flange 93B of the contact 93 and bends from the edge of the flange 93B to extend in the −Z direction. The blade member 95 is connected to a −Z directional end of the flexible substrate connection portion 97, has a flat plate shape extending along an XZ plane, and is disposed such that its pointed portion 95A faces in the −Z direction.

As with the contact member 86 in Embodiment 6, the contact member 96 is configured such that, when the tubular portion 93A of the contact 93 is inserted in the contact through-hole 82B of the housing 82, the flexible substrate connection portion 97 extends in the −Z direction along the outer surfaces of the projection 82C of the housing 82.

The base member 94 used in Embodiment 7 has projection accommodating portions 94A of recess shape opening in the +Z direction, and the bottom of each projection accommodating portion 94A is provided with a blade member accommodating groove 94B penetrating in the Z direction along an XZ plane.

The projection accommodating portion 94A of the base member 94 has an inside diameter smaller than a value obtained by adding: the outside diameter of the projection 82C of the housing 82; a double of the sum of the thickness of the flexible substrate 21 at the portion where the flexible conductor 21C is exposed and the thickness of the flexible conductor 21C; and the thickness of the flexible substrate connection portion 97.

Figure 34:
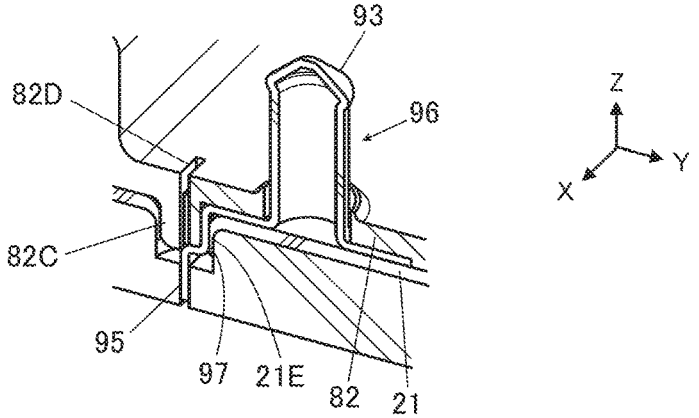
FIG. 34 is a cutaway perspective view showing a main part of the connector according to Embodiment 7.
Figure 35:
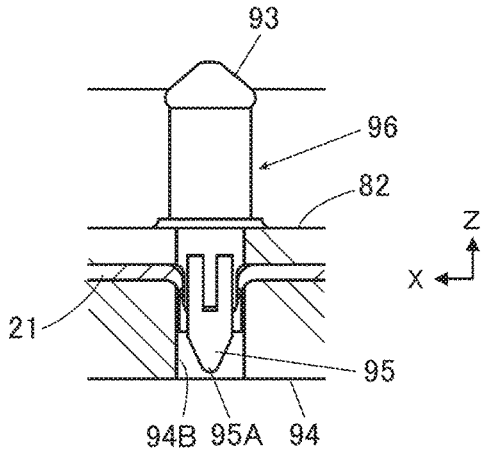
FIG. 35 is a cross-sectional front view showing the connector according to Embodiment 7.
Figure 36:
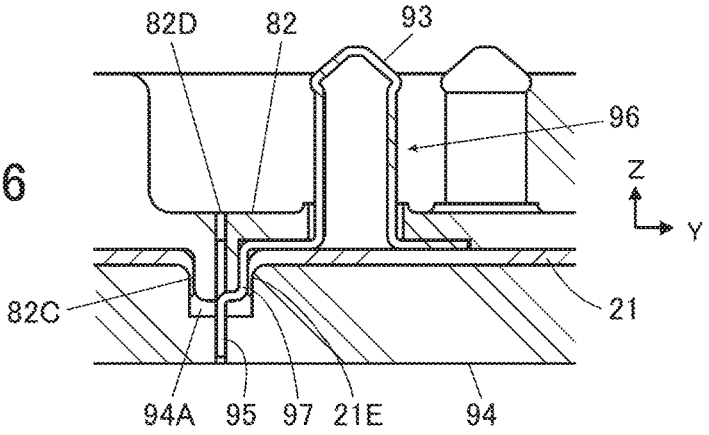
FIG. 36 is a cross-sectional side view showing the connector according to Embodiment 7.
Figure 37:
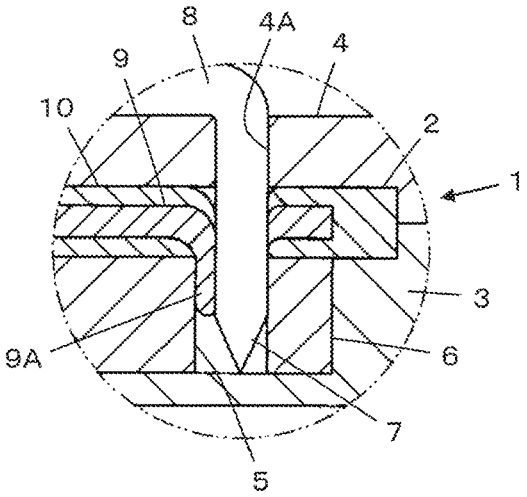
FIG. 37 PRIOR ART
FIG. 37 is a partial cross-sectional view showing a conventional connector mounted on a flat cable.

When the housing 82 and the base member 94 are moved so that they come close to each other as sandwiching the flexible substrate 21 therebetween, as shown in FIGS. 34 to 36, a +Z direction-side portion of the blade member 95 of the contact member 96 is accommodated in the blade member accommodating groove 82D of the projection 82C of the housing 82 while the pointed portion 95A of the blade member 95 facing in the −Z direction cuts the flexible substrate 21 and the flexible conductor 21C, and then the projection 82C of the housing 82 is inserted into the projection accommodating portion 94A of the base member 94. At this time, since the flexible substrate connection portion 97 of the contact member 96 lies along the outer surfaces of the projection 82C of the housing 82, the cut-end-portions 21E of the flexible substrate 21 and the flexible substrate connection portion 97 of the contact member 96 are sandwiched between the outer surfaces of the projection 82C of the housing 82 and the inner surface of the projection accommodating portion 94A of the base member 94, and the flexible conductor 21C of the flexible substrate 21 comes into contact with the flexible substrate connection portion 97 of the contact member 96.

As described above, the projection accommodating portion 94A of the base member 94 has an inside diameter smaller than a value obtained by adding: the outside diameter of the projection 82C of the housing 82; a double of the sum of the thickness of the flexible substrate 21 at the portion where the flexible conductor 21C is exposed and the thickness of the flexible conductor 21C; and the thickness of the flexible substrate connection portion 97. Accordingly, the flexible conductor 21C at the cut-end-portions 21E is pressed by the projection 82C against a surface of the flexible substrate connection portion 97 such that a contact pressure is applied thereto, whereby the contact member 96 is electrically connected to the flexible conductor 21C.

Thus, a connector having excellent reliability in electrical connection with the flexible conductor 21C of the flexible substrate 21 can be obtained.

As shown in FIG. 35, the pointed portion 95A of the blade member 95 that has cut the flexible substrate 21 and the flexible conductor 21C is accommodated within the blade member accommodating groove 94B of the base member 94.

While the contacts 13, 73, 83 and 93 of plug type are used in Embodiments 1 to 7 above, the invention is not limited thereto, and a connector may be configured such that a receptacle-type contact is connected to the flexible conductor 21C of the flexible substrate 21 in the same manner.

What is claimed is:

1. A connector to be mounted on a flexible substrate that has a top surface and a bottom surface facing in opposite directions to each other and has a conductive portion exposed at least on the top surface, the connector comprising:

a base member having a first surface facing the bottom surface of the flexible substrate;

a contact made of a conductive material and having a second surface facing the conductive portion exposed on the top surface of the flexible substrate;

a projection protrudingly formed at one of the base member and the contact;

a projection accommodating portion of recess shape disposed at the other of the base member and the contact and configured to accommodate the projection as sandwiching the flexible substrate therebetween; and a blade member configured to cut the flexible substrate at a position corresponding to the projection when the projection is accommodated in the projection accommodating portion with the flexible substrate being sandwiched therebetween, wherein the projection has a size in a thickness direction of the blade member larger than a thickness of the blade member, and wherein the first surface of the base member comes into contact with the bottom surface of the flexible substrate while the second surface of the contact comes into contact with the top surface of the flexible substrate, the contact is fixed to the base member with the projection being accommodated in the projection accommodating portion, and a cut-end-portion of the flexible substrate cut with the blade member is sandwiched between an outer surface of the projection and an inner surface of the projection accommodating portion, whereby the conductive portion comes into contact with the contact, so that the contact is electrically connected to the conductive portion.

2. The connector according to claim 1, wherein the projection is protrudingly formed at the first surface of the base member, and wherein the projection accommodating portion is provided at the second surface of the contact.

3. The connector according to claim 2, wherein the blade member is fixed to the projection.

4. The connector according to claim 3, wherein the base member and the projection are integrally formed from an insulating material, and wherein the blade member is made of a metal material and attached to the projection.

5. The connector according to claim 3, wherein the base member is made of an insulating material, and wherein the projection and the blade member are integrally formed from a metal material and are attached to the base member.

6. The connector according to claim 2, wherein the blade member is made of a metal material and fixed to an inside of the projection accommodating portion.

7. The connector according to claim 6, wherein the projection has a blade member accommodating groove configured to accommodate the blade member when the projection is accommodated in the projection accommodating portion.

8. The connector according to claim 1, wherein the blade member is smaller in width than the conductive portion of the flexible substrate.

9. The connector according to claim 1, wherein the outer surface of the projection extends parallel to a direction in which the projection protrudes.

10. A connector to be mounted on a flexible substrate that has a top surface and a bottom surface facing in opposite directions to each other and has a conductive portion exposed at least on the top surface, the connector comprising:

a base member having a first surface facing the bottom surface of the flexible substrate;

a contact made of a conductive material and having a second surface facing the conductive portion exposed on the top surface of the flexible substrate;

a housing to be fixed relative to the base member to thereby fix the contact to the base member;

a projection formed at one of the base member and the housing;

a projection accommodating portion of recess shape disposed at the other of the base member and the housing and configured to accommodate the projection as sandwiching the flexible substrate therebetween; and a blade member configured to cut the flexible substrate at a position corresponding to the projection when the projection is accommodated in the projection accommodating portion with the flexible substrate being sandwiched therebetween, wherein the projection has a size in a thickness direction of the blade member larger than a thickness of the blade member, wherein the contact has a flexible substrate connection portion that is inserted into the projection accommodating portion when the contact is fixed to the base member by means of the housing, and wherein the first surface of the base member comes into contact with the bottom surface of the flexible substrate while the second surface of the contact comes into contact with the top surface of the flexible substrate, the housing is fixed to the base member with the projection being accommodated in the projection accommodating portion, and a cut-end-portion of the flexible substrate cut with the blade member and the flexible substrate connection portion of the contact are sandwiched between an outer surface of the projection and an inner surface of the projection accommodating portion, whereby the conductive portion comes into contact with the flexible substrate connection portion of the contact, so that the contact is electrically connected to the conductive portion.

11. The connector according to claim 10, wherein the base member and the housing are made of an insulating material, and wherein the blade member is made of a metal material and disposed in the projection accommodating portion.

12. The connector according to claim 11, wherein the projection has a blade member accommodating groove configured to accommodate the blade member when the projection is accommodated in the projection accommodating portion.

13. The connector according to claim 10, wherein the base member and the housing are made of an insulating material, and wherein the blade member is made of a metal material and disposed at the projection.

14. The connector according to claim 10, wherein the blade member is smaller in width than the conductive portion of the flexible substrate.

15. The connector according to claim 10, wherein the outer surface of the projection extends parallel to a direction in which the projection protrudes.

* * * * *